US008749460B2

(12) United States Patent
Akimoto et al.

(10) Patent No.: US 8,749,460 B2
(45) Date of Patent: Jun. 10, 2014

(54) IMAGE DISPLAY DEVICE HAVING A RESET SWITCH FOR SETTING A POTENTIAL OF A CAPACITOR TO A PREDETERMINED REFERENCE STATE

(75) Inventors: Hajime Akimoto, Kokubunji (JP); Hiroshi Kageyama, Hachioji (JP); Tohru Kohno, Kokubunji (JP)

(73) Assignees: Japan Display Inc., Tokyo (JP); Panasonic Liquid Crystal Display Co., Ltd., Hyogo-ken (JP)

( * ) Notice: Subject to any disclaimer, the term of this patent is extended or adjusted under 35 U.S.C. 154(b) by 249 days.

(21) Appl. No.: 12/547,613

(22) Filed: Aug. 26, 2009

(65) Prior Publication Data

US 2010/0053144 A1 Mar. 4, 2010

(30) Foreign Application Priority Data

Aug. 27, 2008 (JP) ..... 2008-218829

(51) Int. Cl.
*G09G 3/32* (2006.01)

(52) U.S. Cl.
USPC ..... 345/82; 345/76

(58) Field of Classification Search
USPC ..... 345/76, 82
See application file for complete search history.

(56) References Cited

U.S. PATENT DOCUMENTS

| | | | | |
|---|---|---|---|---|
| 8,149,185 | B2 | 4/2012 | Uchino et al. | |
| 2003/0112205 | A1 | 6/2003 | Yamada | |
| 2006/0244688 | A1 | 11/2006 | Ahn et al. | |
| 2007/0057873 | A1 | 3/2007 | Uchino et al. | |
| 2007/0115225 | A1* | 5/2007 | Uchino et al. | 345/76 |
| 2007/0268210 | A1 | 11/2007 | Uchino et al. | |
| 2008/0030440 | A1* | 2/2008 | Uchino et al. | 345/82 |

FOREIGN PATENT DOCUMENTS

| | | |
|---|---|---|
| CN | 1795484 | 8/2006 |
| JP | 2003-186437 | 7/2003 |
| JP | 2004-347993 | 12/2004 |
| JP | 2006-309149 | 11/2006 |
| JP | 2007-310311 | 11/2007 |
| KR | 10-2006-0113194 | 11/2006 |

* cited by examiner

*Primary Examiner* — Long D Pham
(74) *Attorney, Agent, or Firm* — Antonelli, Terry, Stout & Kraus, LLP.

(57) ABSTRACT

Provided is an image display device including: a plurality of pixel scanning lines; a plurality of signal lines; and a plurality of pixel circuits corresponding to intersections between the pixel scanning lines and the signal lines. Each of the pixel circuits includes: a driver transistor; a light emitting element for emitting light based on the current supplied from the driver transistor; a pixel switch for generating a potential based on an image signal and a scanning signal; a capacitor element for controlling the driver transistor based on a potential difference caused by the potential supplied from the pixel switch; and a reset switch for setting a potential at an end of the capacitor element to a predetermined state based on a scanning signal supplied from one of the pixel scanning lines preceding the scanning signal which corresponds to the corresponding one of the plurality of pixel circuits.

10 Claims, 7 Drawing Sheets

FIG.8 (Prior Art)
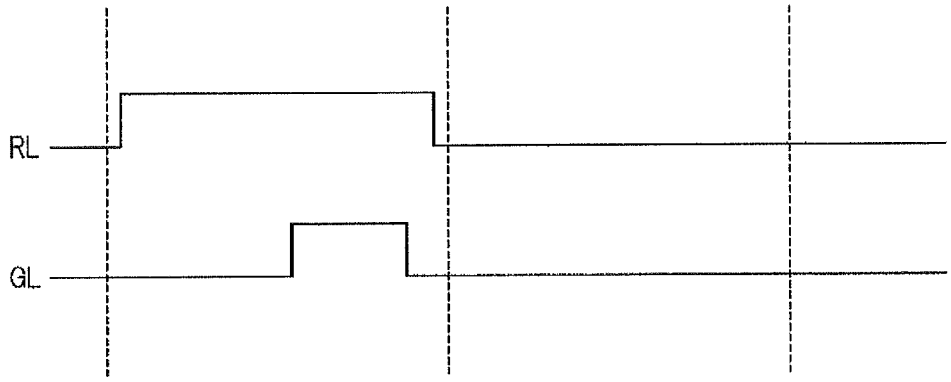

IMAGE DISPLAY DEVICE HAVING A RESET SWITCH FOR SETTING A POTENTIAL OF A CAPACITOR TO A PREDETERMINED REFERENCE STATE

CROSS-REFERENCE TO RELATED APPLICATION

The present application claims priority from Japanese application JP 2008-218829 filed on Aug. 27, 2008, the content of which is hereby incorporated by reference into this application.

BACKGROUND OF THE INVENTION

1. Field of the Invention

The present invention relates to an image display device.

2. Description of the Related Art

In recent years, an image display device using light emitting elements such as organic electroluminescence elements (hereinafter, referred to as organic EL elements) has been developed actively. The light emitting elements are formed on, for example, a glass substrate together with pixel circuits for driving the light emitting elements.

FIG. 7 illustrates a circuit structure of an organic EL display according to a conventional technology. An organic EL element 101 is provided in each of pixel circuits PX. A cathode of the organic EL element 101 is grounded. An anode of the organic EL element 101 is connected to a power supply line Vcc through a driver thin film transistor (hereinafter, also referred to as TFT) 102. A storage capacitor 103 is connected between a gate and source of the driver TFT 102. The gate of the driver TFT 102 is connected to a signal line DL through a pixel switch 104. The signal line DL is connected to a signal input circuit XDV. The anode of the organic EL element 101 is grounded through a reset switch 105. The reset switch 105 is controlled by a reset switch control circuit RDV through a reset switch control line RL. The pixel switch 104 is controlled by a pixel switch control circuit YDV through a pixel switch scanning line GL. Each of the pixel circuits corresponds to a pixel.

FIG. 8 is a waveform diagram illustrating potential waveforms on the pixel switch scanning line GL and the signal line DL which are used for the pixel circuit PX of the conventional organic EL display. In the pixel circuit PX into which an image signal input from the signal line is to be written, firstly, the reset switch 105 is turned on through the reset switch control line RL. At this time, both the cathode and anode of the organic EL element 101 are reset to a ground potential, and simultaneously one end of the storage capacitor 103 is set to the ground potential. Next, the pixel switch 104 of the corresponding pixel is turned on through the pixel switch scanning line GL of the corresponding pixel. At this time, a signal voltage which is being applied to the signal line DL is applied to the other end of the storage capacitor 103, and hence the signal voltage is produced between both the ends of the storage capacitor 103. Next, when the pixel switch scanning line GL and the reset switch control line RL which are used for the corresponding pixel are turned off in the stated order, the signal voltage is held between both the ends of the storage capacitor 103. The voltage between both the ends of the storage capacitor 103 is equal to a gate-source voltage of the driver TFT 102, and hence the driver TFT 102 causes the organic EL element 101 to drive with a signal current corresponding to the signal voltage and to emit light. Therefore, according to the conventional organic EL display, even when a current flowing into the organic EL display element 101 makes the voltage applied between both the ends of the storage capacitor 103 unstable, the amount of current flowing into the organic EL element 101 is prevented from accidentally varying and an image including a plurality of pixels is displayed.

The image display device as described above is described in, for example, JP 2004-347993 A.

As illustrated in FIG. 7, the image display device described above requires two control lines per each pixel row. Therefore, a wiring structure for controlling the pixel circuits is complicated. When the reset switch control circuit RDV and the pixel switch control circuit YDV are externally mounted, the necessary number of connection terminals is two times the number of pixel rows.

SUMMARY OF THE INVENTION

It is an object of the present invention to provide an image display device having a simplified wiring structure for controlling pixel circuits.

According to the present invention, an image display device includes: a plurality of pixel scanning lines extending in a first direction; a plurality of signal lines extending in a second direction crossing the first direction; and a plurality of pixel circuits which are provided correspondingly to intersections between the plurality of pixel scanning lines and the plurality of signal lines. The plurality of pixel circuits are driven based on scanning signals supplied to the plurality of pixel scanning lines and image signals supplied to the plurality of signal lines. Each of the plurality of pixel circuits includes: a driver transistor for adjusting an amount of current; a light emitting element for emitting light based on the current supplied from the driver transistor; a pixel switch for generating a first potential based on one of the scanning signals and one of the image signals; a capacitor element having a first end supplied with the first potential from the pixel switch and a second end supplied with a second potential, for controlling the amount of current supplied from the driver transistor based on a potential difference between the first potential and the second potential; and a reset switch for setting a potential at the second end of the capacitor element to a predetermined reference state based on the scanning signal supplied from one of the pixel scanning lines preceding the scanning signal supplied from another one of the pixel scanning lines which corresponds to corresponding one of the plurality of pixel circuits.

According to an aspect of the present invention, the pixel switch may be provided between the first end of the capacitor element and one of the plurality of signal lines, the reset switch may include a first end connected to the second end of the capacitor element and a second end supplied with a reference potential, the driver transistor may include a source electrode, a gate electrode, and a drain electrode, the light emitting element may include a first end connected to the source electrode of the driver transistor and a second end supplied with the reference potential, the first end of the capacitor element may be connected to the gate electrode of the driver transistor, the second end of the capacitor element may be connected to the source electrode of the driver transistor, and the drain electrode of the driver transistor may be supplied with a power supply potential.

According to another aspect of the present invention, the pixel switch may include a thin film transistor including a gate electrode connected to the one of the plurality of pixel scanning lines which corresponds to the corresponding one of the plurality of pixel circuits, and the reset switch may include a thin film transistor including a gate electrode connected to the pixel scanning line which supplies the scanning signal precedingly to the one of the plurality of pixel scanning lines which corresponds to the corresponding one of the plurality of pixel circuits.

According to still another aspect of the present invention, each of the image signals may include: a base potential which is predetermined and supplied for a first period of time longer than a time constant of the light emitting element; and an intensity potential which corresponds to an intensity of the light emitting element and is supplied for a second period of time shorter than the first period of time immediately after the base potential is supplied.

According to still another aspect of the present invention, the light emitting element may include an organic electroluminescence element.

According to still another aspect of the present invention, the image display device may further include a scanning circuit for generating the scanning signals.

According to still another aspect of the present invention, the pixel circuits may be formed on an insulating substrate.

According to still another aspect of the present invention, the light emitting element may include an organic electroluminescence element, the driver transistor may include an n-channel transistor, the first end of the light emitting element may be an anode connected to the source electrode of the driver transistor, the second end of the light emitting element may be a cathode supplied with the reference potential, and the power supply potential may be higher than the reference potential.

According to still another aspect of the present invention, the light emitting element may include an organic electroluminescence element, the driver transistor may include a p-channel transistor, the first end of the light emitting element may be a cathode connected to the source electrode of the driver transistor, the second end of the light emitting element may be an anode supplied with the reference potential, and the power supply potential may be lower than the reference potential.

According to the present invention, only a single control line is provided for each pixel row, and hence a wiring structure for controlling the pixel circuits may be simplified. When a control circuit is externally mounted, the number of connection terminals may be reduced. As a result, a cost may be effectively reduced.

BRIEF DESCRIPTION OF THE DRAWINGS

In the accompanying drawings:

FIG. 8 is a waveform diagram illustrating potential waveforms on a pixel switch scanning line and a signal line which are used for a pixel circuit in the conventional organic EL display.

DETAILED DESCRIPTION OF THE INVENTION

Hereinafter, embodiments of the present invention are described in detail with reference to the attached drawings. In the following, examples in which the present invention is applied to organic EL displays are described.

First Embodiment

An organic EL display according to a first embodiment of the present invention includes a glass substrate in which organic EL elements and circuits for driving the organic EL elements are formed in matrix for respective pixels in a display region, and a sealing substrate which is bonded to the glass substrate to seal the organic EL elements.

Figure 1:
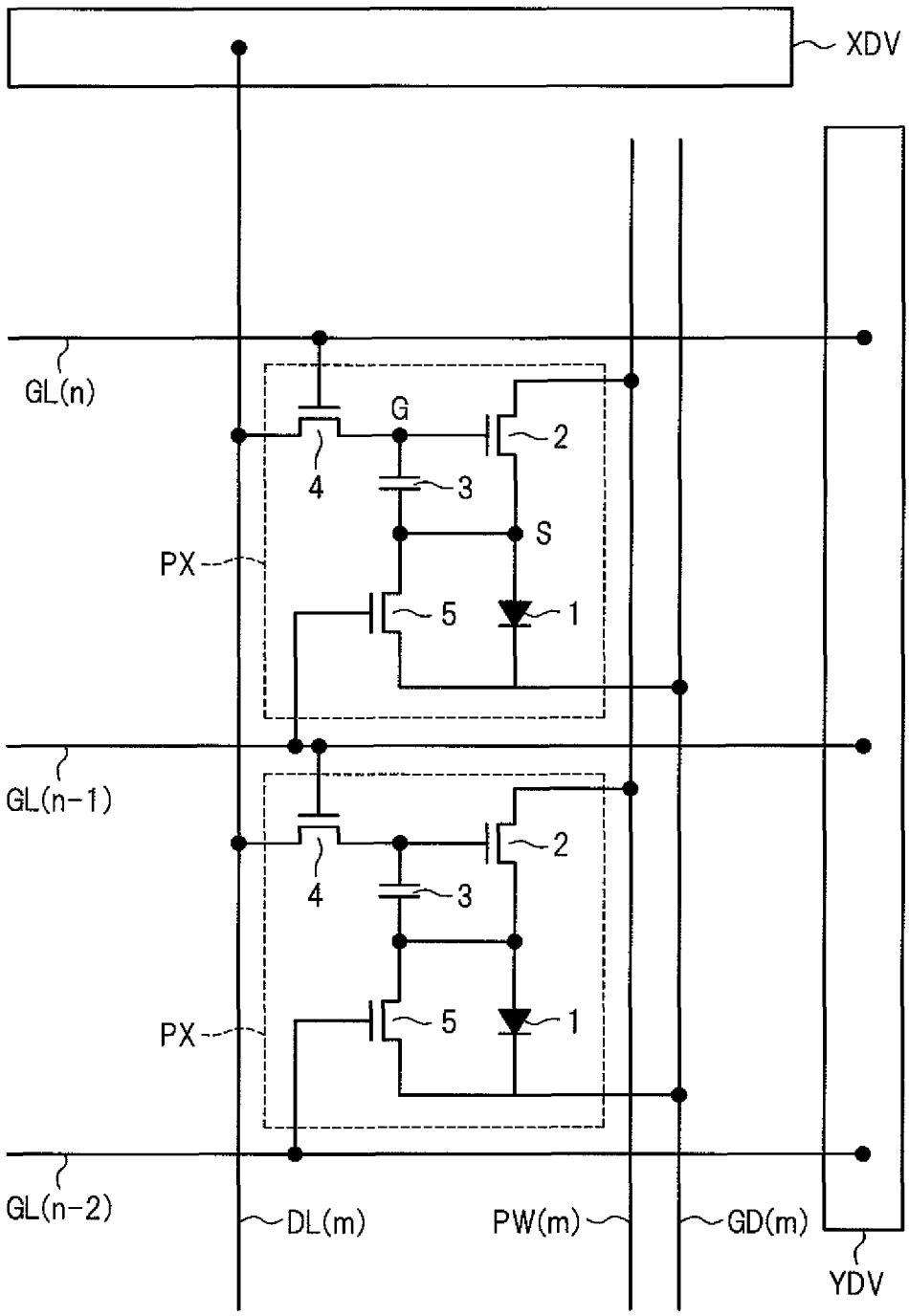
FIG. 1 illustrates a circuit structure of an organic EL display according to a first embodiment of the present invention.

FIG. 1 illustrates a circuit structure of the organic EL display according to the first embodiment. In the display region, a plurality of pixel switch scanning lines GL extend in a first direction (lateral direction) and a plurality of signal lines DL extend in a second direction (longitudinal direction). The pixel switch scanning lines GL are connected to a pixel switch control circuit YDV. The signal lines DL are connected to a signal input circuit XDV. Pixel circuits PX are arranged in matrix correspondingly to two-dimensional intersections between the pixel switch scanning lines GL and the signal lines DL. Each of the pixel circuits PX corresponds to a pixel on the display. FIG. 1 illustrates only two pixel circuits PX (one column and two rows), but a large number of the pixel circuits PX are actually arranged for image output in the lateral direction and the longitudinal direction. In a case of an organic EL display for a television, for example, 1,920 (lateral)×RGB×1,080 (longitudinal) pixel circuits PX are arranged. Hereinafter, an n-th pixel switch scanning line is expressed by GL(n) and an m-th signal line is expressed by DL(m), where n indicates an integer equal to or larger than one and equal to or smaller than the number of pixel switch scanning lines and m indicates an integer equal to or larger than one and equal to or smaller than the number of signal lines. A power supply wiring PW(m) and a ground wiring GD(m) are provided parallel to each other in the display region and extend in the longitudinal direction. The power supply wiring PW(m) is supplied with a positive power supply potential. A first pixel switch scanning line GL(1), a second pixel switch scanning line GL(2), a third pixel switch scanning line GL(3), . . . are supplied with scanning signals from the pixel switch control circuit YDV in the stated order.

Next, the pixel circuit PX provided correspondingly to the intersection between the pixel switch scanning line GL(n) and the signal line DL(m) is described. An organic EL element 1 is provided in the pixel circuit PX. A cathode of the organic EL element 1 is connected to the ground wiring GD(m) and an anode thereof is connected to a source electrode of a driver TFT 2. A drain electrode of the driver TFT 2 is connected to the power supply wiring PW(m). A storage capacitor 3 is connected between the gate electrode and source electrode of the driver TFT 2. The gate electrode of the driver TFT 2 is connected to the signal line DL(m) through a pixel switch 4. The anode of the organic EL element 1 is connected to the ground wiring GD(m) through a reset switch 5. A gate electrode of the pixel switch 4 is connected to the pixel switch scanning line GL(n) and controlled by the pixel switch control circuit YDV. A gate electrode of the reset switch 5 is connected to the pixel switch scanning line GL(n−1) corresponding to the pixel circuit PX provided at a preceding stage. Many organic EL elements have rectifying characteristics and thus are also called an organic light emitting diode (OLED), and hence the organic EL element 1 is expressed by a diode symbol in FIG. 1.

Each of the pixel circuits PX in the display region is provided on the single glass substrate and includes polycrystalline Si-TFT elements. Each of the signal input circuit XDV and the pixel switch control circuit YDV includes a plurality of single-crystalline Si driver IC chips and is mounted on the single glass substrate. Each of the driver TFT 2, the pixel switch 4, and the reset switch 5 is an nMOS transistor. Note that, when a polycrystalline Si-TFT circuit or an amorphous Si-TFT circuit is manufactured, there is a variation in characteristics of driver TFTs due to the properties of silicon. Even in this embodiment, a threshold voltage Vth of the driver TFT 2 which is a polycrystalline Si-TFT element varies.

In this embodiment, a group including the pixel circuits PX corresponding to a pixel switch scanning line GL is selected based on the scanning signal supplied to the pixel switch scanning line GL concerned. Image signals are input to the pixel circuits PX belonging to the selected group through the signal lines DL. The storage capacitor 3 of each of the pixel circuits PX holds a potential difference corresponding to an input image signal. Light is emitted from the organic EL element 1 based on a current corresponding to the potential difference.

Figure 2:
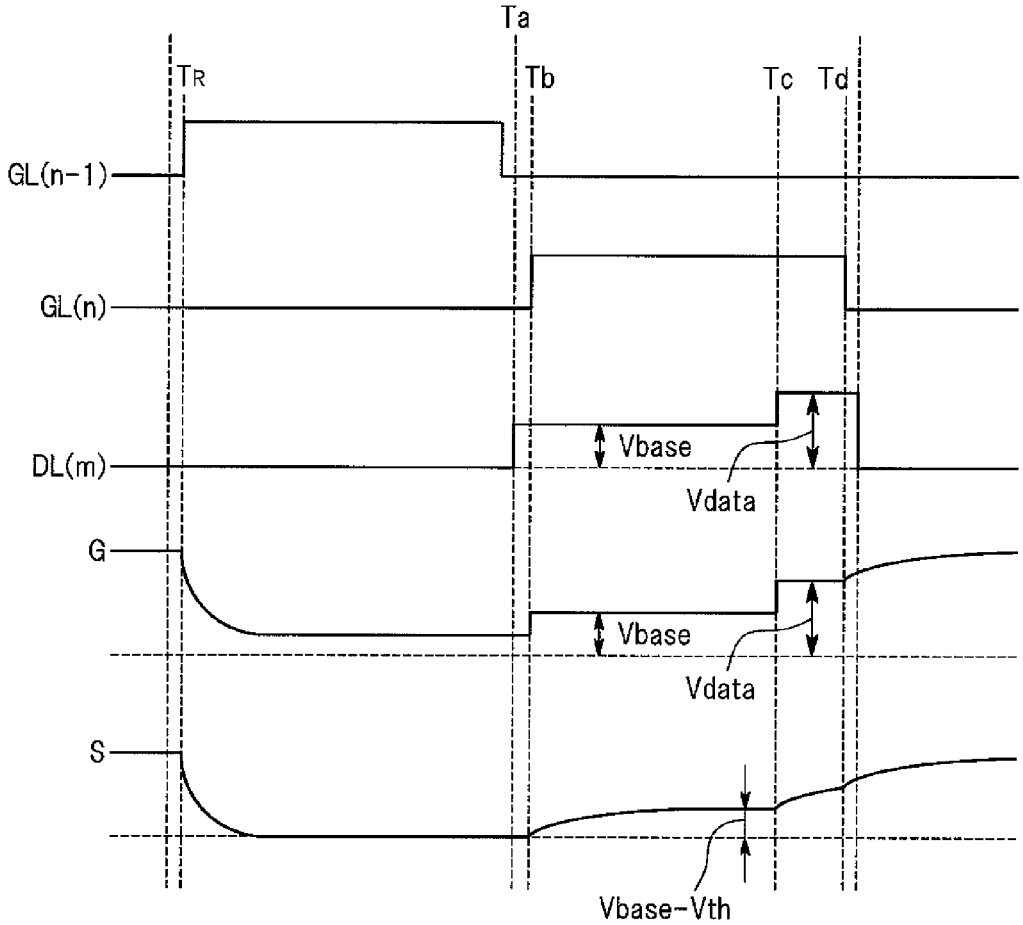
FIG. 2 is a waveform diagram illustrating potential waveforms on pixel switch scanning lines and a signal line and at a point G and a point S of a pixel circuit in the first embodiment.

Hereinafter, signals input to the pixel circuit PX and an operation of the pixel circuit PX in this embodiment are described in detail. FIG. 2 is a waveform diagram illustrating potential waveforms on the pixel switch scanning lines GL(n−1) and GL(n) and the signal line DL(m) and at a point G and a point S of the pixel circuit PX in this embodiment. The point G and the point S of the pixel circuit PX in FIG. 2 are points of the pixel circuit PX corresponding to the pixel switch scanning line GL(n) illustrated in FIG. 1. The point G corresponds to the gate electrode of the driver TFT 2 and the point S corresponds to the source electrode of the driver TFT 2. In FIG. 2, the upper side of waveforms is a higher potential side and a broken line extending in the lateral direction indicates a ground potential.

Before the input of an image signal to the pixel circuit PX provided in a row corresponding to the pixel switch scanning line GL(n) (hereinafter, referred to as target pixel circuit), an image signal is input to the pixel circuit PX provided in a preceding row. In this case, at a timing TR, the potential of the pixel switch scanning line GL(n−1) becomes a high level (H) and thus a scanning signal is supplied. Then, the reset switch 5 of the target pixel circuit is turned on. At this time, both the cathode and anode of the organic EL element 1 are connected to the ground wiring GD(m) to be reset to the ground potential. Simultaneously, one end of the storage capacitor 3 is set to the ground potential.

Next, the potential of the pixel switch scanning line GL(n−1) becomes a low level (L) and thus the reset switch 5 of the target pixel circuit PX is turned off. Subsequently, at a timing Ta, the potential of the image signal supplied to the signal line DL(m) becomes a base potential Vbase. The base potential Vbase is predetermined and does not vary depending on a change in signal. At a timing Tb immediately after the timing Ta, a scanning signal having a high level potential is supplied to the pixel switch scanning line GL(n) to turn on the pixel switch 4 of the target pixel circuit. At this time, the base potential Vbase of the image signal supplied to the signal line DL(m) is applied to the point G which is a connection node between the other end of the storage capacitor 3 and the gate electrode of the driver TFT 2, and hence a current flows into the source electrode of the driver TFT 2. At this time, the reset switch 5 is already in the off state, and hence charges are written correspondingly to a parasitic capacitance of the organic EL element 1. Then, the potential at the point S which is a connection node among the one end of the storage capacitor 3, the anode of the organic EL element 1, and the source electrode of the driver TFT 2 increases as illustrated in FIG. 2. After a lapse of time sufficient for a time constant $\tau$ determined based on the resistance and parasitic capacitance of the organic EL element 1, a current stops flowing, and the potential at the point S becomes "(potential at point G which is gate electrode of driver TFT 2)−(threshold voltage Vth of driver TFT 2)". That is, in this case, a potential difference (threshold voltage Vth of driver TFT 2) is held between the point G and the point S which are both the ends of the storage capacitor 3. The base potential Vbase is preferably set to a value which is larger than the highest value of the threshold voltages Vth of the driver TFTs 2 of the respective pixel circuits and lower than a threshold voltage of the organic EL element 1.

After that, when the potential of the image signal supplied to the signal line DL(m) is adjusted from the base potential Vbase to an intensity potential Vdata at a timing Tc, the potential at the point G which is the connection node between the other end of the storage capacitor 3 and the gate electrode of the driver TFT 2 is changed from the base potential Vbase to the intensity potential Vdata. When the potential at the point G changes, the potential at the point S which is the connection node with the source electrode of the driver TFT 2 is increased again by a difference between the intensity potential Vdata and the base potential Vbase. A variation in potential at the point S is not more rapid than a variation in potential at the point G because the parasitic capacitance (approximately several pF in this embodiment) of the organic EL element 1 is larger than a capacitance (approximately 100 fF in this embodiment) of the storage capacitor 3. Further, the potential at the point G is written by the saturation operation of the pixel switch 4. In contrast to this, even when the potential at the point S is written by the non-saturation operation of the driver TFT 2, the variation in potential at the point S becomes slower. Therefore, at a timing Td when the variation in potential at the point S is small, the voltage of the pixel switch scanning line GL(n) is set to a low level, the supply of the scanning signal is stopped, and the pixel switch 4 of the target pixel circuit is turned off. Then, a potential difference of "(threshold voltage Vth of driver TFT 2)+(difference between intensity potential Vdata and base potential Vbase)×k-times" is held between the point G and the point S which are both the ends of the storage capacitor 3. This is because, when the pixel switch 4 is turned off, the point G becomes a high impedance, and hence a further potential difference is not provided between the point G and the point S which are both the ends of the storage capacitor 3. Note that "k-times" indicates a variable equal to or larger than 0 and smaller than 1, which is varied by the difference between the intensity potential Vdata and the base potential Vbase. A period between the timings Tc and Td is preferably set to a time which is not larger than the time constant $\tau$ determined based on the resistance and parasitic capacitance of the organic EL element 1.

According to the operation described above, the potential difference between the point G and the point S which are both the ends of the storage capacitor 3 is "(threshold voltage Vth of driver TFT 2)+(difference between intensity potential Vdata and base potential Vbase)×k-times". The potential difference is held in the storage capacitor 3. The potential difference between both the ends of the storage capacitor 3 is a gate-source voltage of the driver TFT 2, and hence the organic EL element 1 is driven by the driver TFT 2 with a signal current corresponding to the voltage described above to emit light with a corresponding intensity. Here, a current flowing from the driver TFT 2 to the organic EL element 1 may be calculated based on a value obtained by subtracting the threshold voltage Vth from the potential difference held by the storage capacitor 3. A relationship between the current and the intensity may be also obtained in advance. The base potential Vbase is a constant value, and hence the intensity potential Vdata corresponding to a desired intensity may be calculated without depending on a variation in the threshold voltage Vth. After the timing Td, the potential at the point S is increased by the current flowing through the organic EL element 1, but the potential difference between the point G and the point S is held. Therefore, the current flowing from the driver TFT 2 to the organic EL element 1 does not reduce.

When the scanning signal is controlled by the pixel switch control circuit YDV and the signal input circuit XDV supplies the base potential Vbase and the intensity potential Vdata which have no relation to the value of the threshold voltage Vth of the driver TFT 2, the organic EL element 1 may be caused to emit with the desired intensity.

Therefore, according to the organic EL display in this embodiment, the single pixel switch scanning line GL is used for each pixel row, and hence a desired image may be displayed. Further, the variation in threshold voltage Vth may be cancelled by the control described above to significantly suppress a variation in the amount of current of the light emitting element due to the variation in threshold voltage. Thus, an image quality problem such as a variation in intensity of the light emitting element or intensity burning caused by the shift of the threshold voltage Vth in some cases may be avoided.

A structure of the pixel circuit PX in this embodiment is described with reference to FIG. 3.

Figure 3:
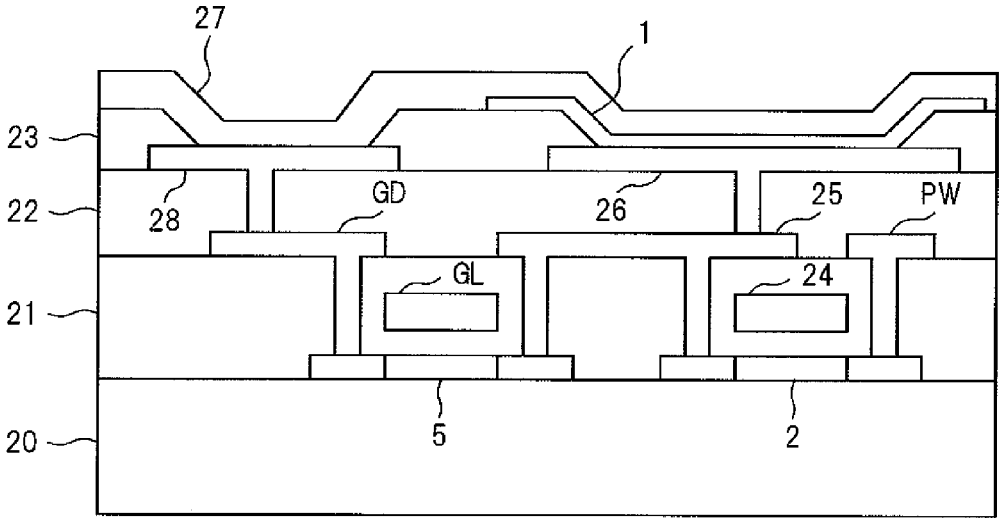
FIG. 3 is a cross sectional view illustrating the pixel circuit formed on a glass substrate.

FIG. 3 is a cross sectional view illustrating the pixel circuit PX formed on a glass substrate 20. The organic EL display element 1, the driver TFT 2, the reset switch 5, and the pixel switch scanning line GL are illustrated in cross section.

The organic EL element 1 is provided between a cathode electrode 27 and an anode electrode 26. The anode electrode 26 is connected to the source electrode of the driver TFT 2 and one end of the reset switch 5 through a connection wiring 25. The other end of the reset switch 5 is connected to the ground wiring GD(m). The ground wiring GD(m) is connected to the cathode electrode 27 through a cathode connection electrode 28. As illustrated in FIG. 1, the drain electrode of the driver TFT 2 is connected to the power supply wiring PW(m). The gate electrode of the reset switch 5 is connected to the pixel switch scanning line GL(n−1). A gate electrode 24 of the driver TFT 2 is connected to the point G of the pixel circuit PX which is not illustrated in FIG. 3.

The entire circuit structure is provided on the glass substrate 20. Interlayer insulating films 21, 22, and 23 are provided on the circuit structure. A channel portion of each of the driver TFT 2 and the reset switch 5 corresponds to a polycrystalline Si thin film having a thickness of 50 nm and is provided between the glass substrate 20 and the interlayer insulating film 21. The pixel switch scanning line GL(n−1) and the gate electrode 24 of the driver TFT 2 are provided as metal wiring layers above the channel portion of the reset switch 5 and the channel portion of the driver TFT 2, respectively. The ground wiring GD(m), the connection wiring 25, and the power supply wiring PW(m) are metal wiring layers provided between the interlayer insulating films 21 and 22. The ground wiring GD(m) is connected to one end of the channel portion of the reset switch 5. The power supply wiring PW(m) is connected to one end of the channel portion of the driver TFT 2. The connection wiring 25 is connected to the other end of the channel portion of the driver TFT 2 and the other end of the channel portion of the reset switch 5, which are not connected to the ground wiring GD(m) and the power supply wiring PW(m). The cathode connection electrode 28 and the anode electrode 26 are metal wiring layers provided on the interlayer insulating film 22. In regions located above the metal wiring layers, there are regions that the interlayer insulating film 23 is not provided. The cathode connection electrode 28 is connected to the ground wiring GD(m). There is a region that the anode electrode 26 is connected to the connection wiring 25. The interlayer insulating film 23 is not provided in the region located above the anode electrode 26, and hence the organic EL element 1 is provided in the region and on a portion of the interlayer insulating film 23. The cathode electrode 27 which is a transparent electrode made of indium tin oxide (ITO) is provided on the organic EL element 1 and the cathode connection electrode 28.

As described above, according to the pixel circuit PX in this embodiment, each of the pixels in the display region is provided on the single glass substrate 20 and includes the polycrystalline Si-TFT elements. Each of the signal input circuit XDV and the pixel switch control circuit YDV includes the plurality of single-crystalline Si driver IC chips and is provided on the glass substrate 20. However, each of the signal input circuit XDV and the pixel switch control circuit YDV may include the polycrystalline Si-TFT elements as in the case of each of the pixels. Alternatively, each of the signal input circuit XDV and the pixel switch control circuit YDV may be realized by a combination of using the polycrystalline Si-TFT element in a part of the pixel switch control circuit YDV and the signal input circuit XDV and using the single-crystalline Si driver IC chip in the remaining part thereof.

It is apparent that, in this embodiment, an amorphous Si thin film or another organic/inorganic semiconductor thin film instead of the polycrystalline Si thin film may be used for the transistors, another substrate having an insulating surface may be used instead of the glass substrate, a bottom gate type instead of the top gate type as described above may be used for the transistors, and a bottom emission type instead of the top emission type as described above may be used for the organic EL element 1.

In this embodiment, the description is based on the assumption that the ground wiring GD(m) is applied with the ground potential. A voltage is a relative value, and hence the applied potential may be not the ground potential but a reference potential for another signal potential or power supply potential. Further, in this embodiment, the reset switch 5 of the pixel circuit PX corresponding to the pixel switch scanning line GL(n) is connected to the pixel switch scanning line GL(n−1) for driving the pixel circuit PX provided at the preceding stage. However, the connection stage is not limited to the preceding stage. For example, the reset switch 5 of the pixel circuit PX corresponding to the pixel switch scanning line GL(n) is preferably connected to the pixel switch scanning line GL corresponding to the pixel circuit PX driven prior to the pixel circuit PX corresponding to the pixel switch scanning line GL(n), such as the pixel switch scanning line GL(n−2).

Second Embodiment

An organic EL display according to a second embodiment of the present invention has the same entire structure and pixel circuit structure as in the first embodiment. Here, a method of writing a signal voltage into a pixel, which is different from the method in the first embodiment, is mainly described.

Figure 4:
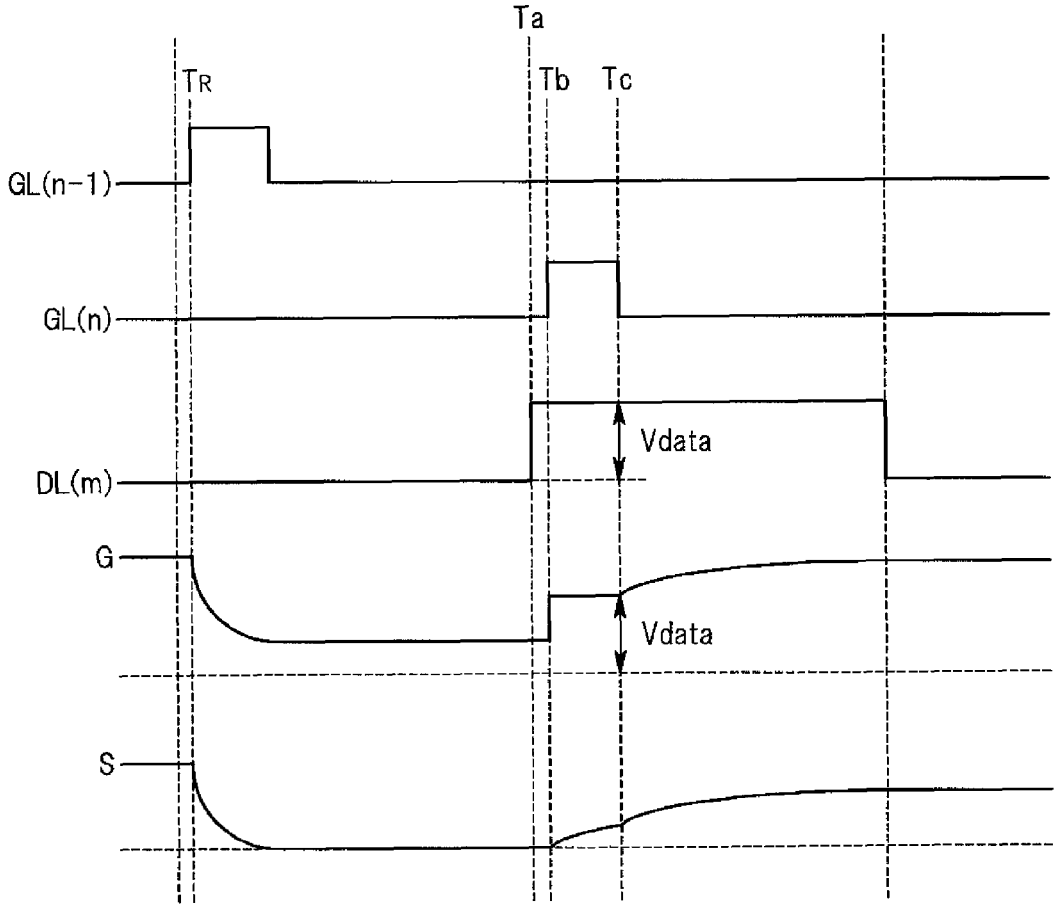
FIG. 4 is a waveform diagram illustrating potential waveforms on pixel switch scanning lines and a signal line and at a point G and a point S of a pixel circuit in a second embodiment of the present invention.

FIG. 4 is a waveform diagram illustrating potential waveforms on the pixel switch scanning lines GL(n−1) and GL(n) and the signal line DL(m) and at the point G and the point S of the pixel circuit PX in this embodiment. The point G and the point S of the pixel circuit PX in FIG. 4 are points of the pixel circuit PX corresponding to the pixel switch scanning line GL(n) illustrated in FIG. 1. The point G corresponds to the gate electrode of the driver TFT 2 and the point S corresponds to the source electrode of the driver TFT 2. In FIG. 4, the upper side of waveforms is a high potential side and a broken line extending in the lateral direction indicates the ground potential.

Before the input of an image signal to the pixel circuit PX provided in a row corresponding to the pixel switch scanning line GL(n) and the signal line DL(m) (hereinafter, referred to as target pixel circuit), an image signal is input to the pixel circuit PX provided in a preceding row. In this case, at a timing TR, the potential of the pixel switch scanning line GL(n−1) becomes a high level (H) and thus a scanning signal is supplied. Then, the reset switch 5 of the target pixel circuit is turned on. At this time, both the cathode and anode of the organic EL element 1 are connected to the ground wiring GD(m) to be reset to the ground potential. Simultaneously, the one end of the storage capacitor 3 is set to the ground potential.

Next, the potential of the pixel switch scanning line GL(n−1) becomes a low level (L) and thus the reset switch 5 of the target pixel circuit PX is turned off. Subsequently, at a timing Ta, the potential of the image signal supplied to the signal line DL(m) becomes the intensity potential Vdata. At a timing Tb immediately after the timing Ta, the potential of the pixel switch scanning line GL(n) becomes a high level (H) and thus a scanning signal is supplied to turn on the pixel switch 4 of the target pixel circuit. At this time, the intensity potential Vdata of the image signal supplied to the signal line DL(m) is applied to the point G which is the connection node between the other end of the storage capacitor 3 and the gate electrode of the driver TFT 2. At this time, the reset switch 5 is already in the off state. Therefore, as illustrated in FIG. 4, the potential at the point S which is the connection node among the one end of the storage capacitor 3, the anode of the organic EL element 1, and the source electrode of the driver TFT 2 is increased by a difference between the ground potential and the intensity potential Vdata. However, a variation in potential at the point S is not more rapid than a variation in potential at the point G because the parasitic capacitance (approximately several pF in this embodiment) of the organic EL element 1 is larger than the capacitance (approximately 100 fF in this embodiment) of the storage capacitor 3. Further, the potential at the point G is written by the saturation operation of the pixel switch 4. In contrast to this, the potential at the point S is written by the non-saturation operation of the driver TFT 2, and hence the variation in potential at the point S is slower than the variation in potential at the point G. Thus, at a timing Tc when the variation in potential at the point S is small, the voltage of the pixel switch scanning line GL(n) is set to a low level, the supply of the scanning signal is stopped, and the pixel switch 4 of the target pixel circuit is turned off. Then, a potential difference of "(difference between intensity potential Vdata and ground potential)×m-times" is held between the point G and the point S which are both the ends of the storage capacitor 3. This is because, when the pixel switch 4 is turned off, the point G becomes a high impedance, and hence a further potential difference is not provided between the point G and the point S which are both the ends of the storage capacitor 3. Note that "m-times" indicates a variable varied by the difference between the intensity potential Vdata and the ground potential.

According to the operation described above, the potential difference between the point G and the point S which are both the ends of the storage capacitor 3 is "(difference between intensity potential Vdata and ground potential)×m-times". The potential difference is held in the storage capacitor 3. The potential difference between both the ends of the storage capacitor 3 is the gate-source voltage of the driver TFT 2, and hence the organic EL element 1 is driven by the driver TFT 2 with a signal current corresponding to the voltage described above to emit light with a corresponding intensity. As is apparent from the relationship described above, the potential difference between the point S and the point G may be obtained based on the intensity potential Vdata and the ground potential.

Therefore, according to the organic EL display in this embodiment, the single pixel switch scanning line GL is used for each pixel row, and hence an image including a plurality of pixels may be displayed. Note that the operating waveform appearing on the signal line DL in this embodiment is simpler than that in the first embodiment, and hence there is an advantage that the signal input circuit XDV may be manufactured at lower cost.

Third Embodiment

An organic EL display according to a third embodiment of the present invention includes pMOS transistors used for the pixel circuits PX. Here, a difference in structure and operation from the first embodiment is mainly described.

Figure 5:
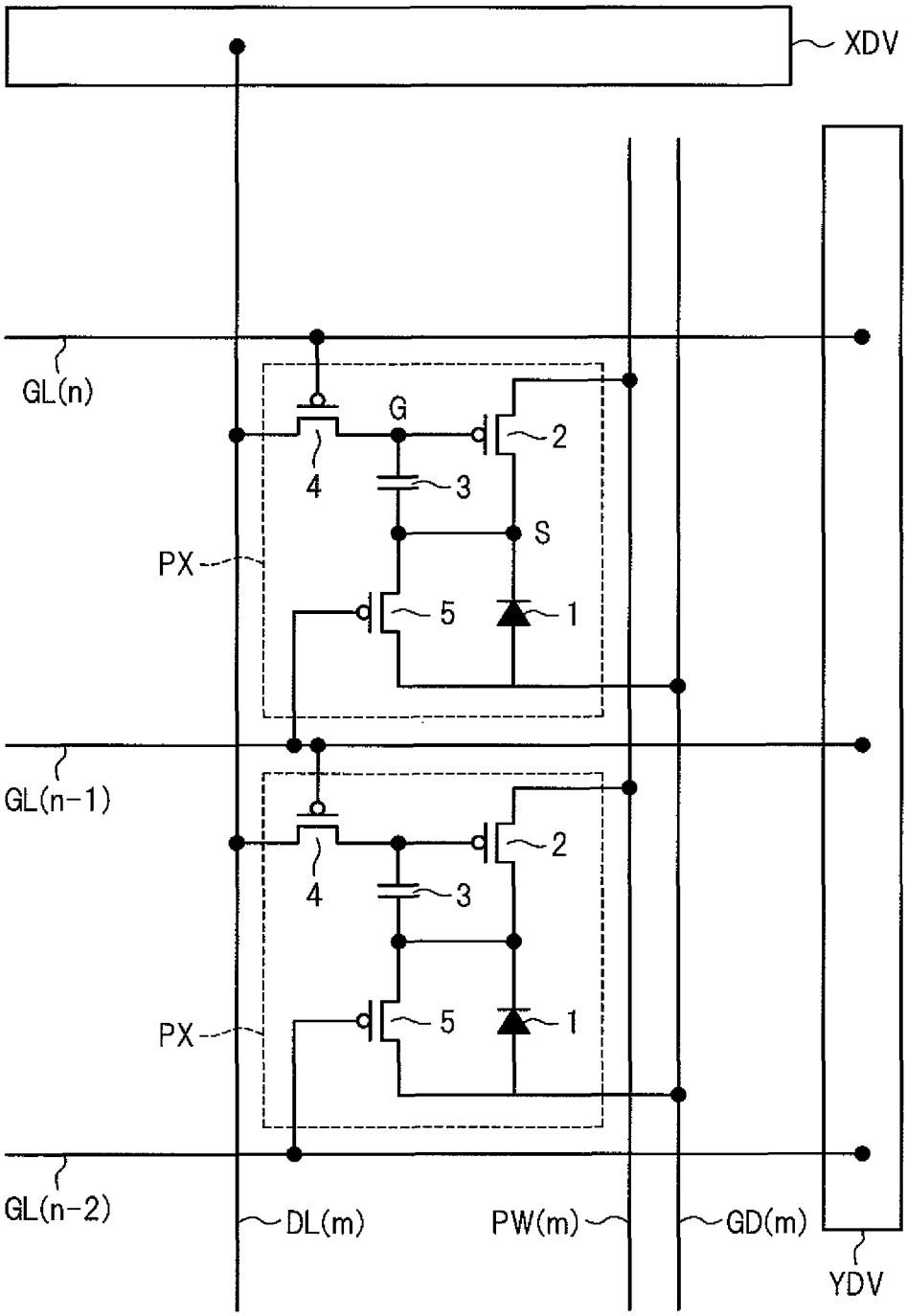
FIG. 5 illustrates a circuit structure of an organic EL display according to a third embodiment of the present invention.

FIG. 5 illustrates a circuit structure of the organic EL display according to the third embodiment. In the display region, a plurality of pixel switch scanning lines GL extend in a first direction (lateral direction) and a plurality of signal lines DL extend in a second direction (longitudinal direction). The pixel switch scanning lines GL are connected to a pixel switch control circuit YDV. The signal lines DL are connected to a signal input circuit XDV. Pixel circuits PX are arranged in matrix correspondingly to two-dimensional intersections between the pixel switch scanning lines GL and the signal lines DL. FIG. 5 illustrates only two pixel circuits PX (one column and two rows), but a large number of the pixel circuits PX are actually arranged for image output in the lateral direction and the longitudinal direction. In a case of an organic EL display for a television, for example, 1,920 (lateral)×RGB×1,080 (longitudinal) pixel circuits PX are arranged. Hereinafter, an n-th pixel switch scanning line is expressed by GL(n) and an m-th signal line is expressed by DL(m), wherein indicates an integer equal to or larger than one and equal to or smaller than the number of pixel switch scanning lines and m indicates an integer equal to or larger than one and equal to or smaller than the number of signal lines. A power supply wiring PW(m) and a ground wiring GD(m) are provided parallel to each other in the display region and extend in the longitudinal direction. The power supply wiring PW(m) is supplied with a positive power supply potential. A first pixel switch scanning line GL(1), a second pixel switch scanning line GL(2), a third pixel switch scanning line GL(3), . . . are supplied with scanning signals from the pixel switch control circuit YDV in the stated order.

Hereinafter, the pixel circuit PX corresponding to the pixel switch scanning line GL(n) and the signal line DL(m) is described. An organic EL element 1 is provided in the pixel circuit PX. An anode of the organic EL element 1 is connected to the ground wiring GD(m) and a cathode thereof is connected to a source electrode of the driver TFT 2. A drain electrode of the driver TFT 2 is connected to the power supply wiring PW(m) which is applied with a negative potential. A storage capacitor 3 is connected between the gate electrode and source electrode of the driver TFT 2. The gate electrode of the driver TFT 2 is connected to the signal line DL(m) through a pixel switch 4. The cathode of the organic EL element 1 is connected to the ground wiring GD(m) through a reset switch 5. The pixel switch 4 is connected to the pixel switch scanning line GL(n) and controlled by the pixel switch control circuit YDV. A gate electrode of the reset switch 5 is connected to the pixel switch scanning line GL(n−1) corresponding to the pixel circuit PX provided at a preceding stage. Note that the power supply wiring PW(m) and the ground wiring GD(m) are provided in parallel in the display region.

Each of the pixel circuits PX in the display region is provided on the single glass substrate and includes polycrystalline Si-TFT elements. Each of the signal input circuit XDV and the pixel switch control circuit YDV includes a plurality of single-crystalline Si driver IC chips and is mounted on the single glass substrate. Note that this embodiment differs from the first embodiment and the second embodiment because each of the driver TFT 2, the pixel switch 4, and the reset switch 5 is a pMOS transistor.

In this embodiment, a group including the pixel circuits PX corresponding to the pixel switch scanning line GL is selected based on the scanning signal supplied to the pixel switch scanning line GL concerned. Image signals are input to the pixel circuits PX belonging to the selected group through the signal lines DL. The storage capacitor 3 of each of the pixel circuits PX holds a potential difference corresponding to an input image signal. Light is emitted from the organic EL element 1 based on a current corresponding to the potential difference.

Figure 6:
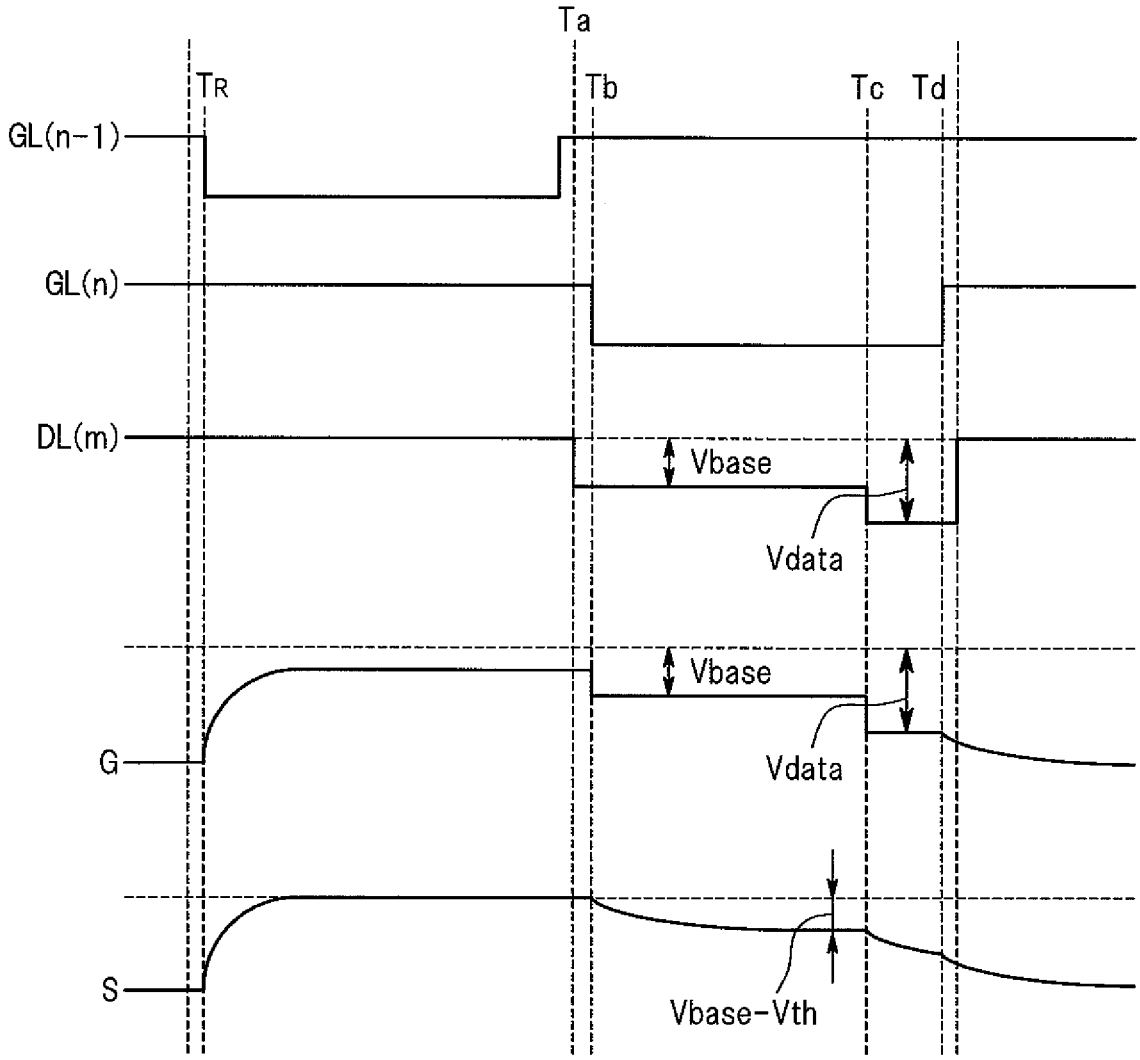
FIG. 6 is a waveform diagram illustrating potential waveforms on pixel switch scanning lines and a signal line and at a point G and a point S of a pixel circuit in the third embodiment.
Figure 7:
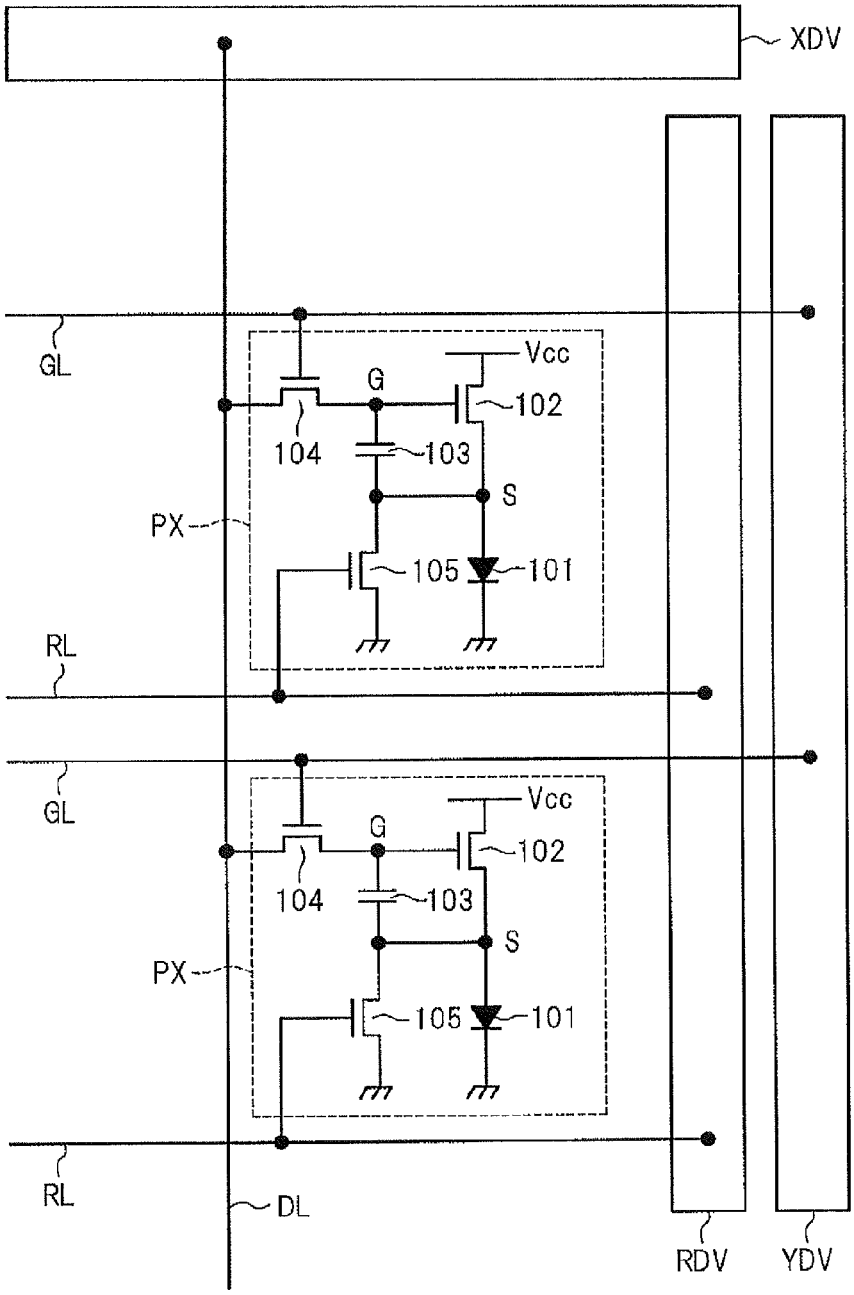
FIG.7 (Prior Art)
FIG. 7 illustrates a circuit structure of an organic EL display according to a conventional technology.

Hereinafter, signals input to the pixel circuit PX and an operation of the pixel circuit PX in this embodiment are described in detail. FIG. 6 is a waveform diagram illustrating potential waveforms on the pixel switch scanning lines GL(n−1) and GL(n) and the signal line DL(m) and at a point G and a point S of the pixel circuit PX in this embodiment. The point G and the point S of the pixel circuit PX in FIG. 6 are points of the pixel circuit PX corresponding to the pixel switch scanning line GL(n) illustrated in FIG. 5. The point G corresponds to the gate electrode of the driver TFT 2 and the point S corresponds to the source electrode of the driver TFT 2. In FIG. 6, the upper side of waveforms is a higher potential side and a broken line extending in the lateral direction indicates a ground potential.

Before the input of an image signal to the pixel circuit PX provided in a row corresponding to the pixel switch scanning line GL(n) and the signal line DL(m) (hereinafter, referred to as target pixel circuit), an image signal is input to the pixel circuit PX provided in a preceding row. In this case, at a timing TR, the potential of the pixel switch scanning line GL(n−1) becomes a low level (L) and thus a scanning signal is supplied. Then, the reset switch 5 of the target pixel circuit which is a pMOS is turned on. At this time, both the anode and cathode of the organic EL element 1 are connected to the ground wiring GD(m) to be reset to the ground potential. Simultaneously, one end of the storage capacitor 3 is set to the ground potential.

Next, the potential of the pixel switch scanning line GL(n−1) becomes a high level (H) and thus the reset switch 5 of the target pixel circuit PX is turned off. Subsequently, at a timing Ta, the potential of the image signal supplied to the signal line DL(m) becomes a base potential Vbase. At a timing Tb immediately after the timing Ta, a scanning signal having a low level potential is supplied to the pixel switch scanning line GL(n) to turn on the pixel switch 4 of the target pixel circuit. At this time, the potential of the image signal supplied to the signal line DL(m) is the base potential Vbase and the base potential Vbase is applied to the point G which is a connection node between the other end of the storage capacitor 3 and the gate electrode of the driver TFT 2, and hence a current flows into the source electrode of the driver TFT 2. At this time, the reset switch 5 is already in the off state, and hence charges are written correspondingly to a parasitic capacitance of the organic EL element 1. Then, the potential at the point S which is a connection node among the one end of the storage capacitor 3, the cathode of the organic EL element 1, and the source electrode of the driver TFT 2 decreases as illustrated in FIG. 6. After a lapse of time sufficient for a time constant $\tau$ determined based on the resistance and parasitic capacitance of the organic EL element 1, a current stops flowing, and the potential at the point S becomes "(potential at point G which is gate electrode of driver TFT 2)−(threshold voltage Vth of driver TFT 2)". That is, in this case, a potential difference (threshold voltage Vth of driver TFT 2) is held between the point G and the point S which are both the ends of the storage capacitor 3. Here, the base potential Vbase is preferably set to a value which is lower than the lowest value of the threshold voltages Vth of the driver TFTs 2 of the respective pixel circuits and higher than a threshold voltage of the organic EL element 1.

After that, when the potential of the image signal supplied to the signal line DL(m) is adjusted from the base potential Vbase to an intensity potential Vdata at a timing Tc, the potential at the point G which is the connection node between the other end of the storage capacitor 3 and the gate electrode of the driver TFT 2 is changed from the base potential Vbase to the intensity potential Vdata. When the potential at the point G changes, the potential at the point S which is the connection node with the source electrode of the driver TFT 2 is decreased again by a difference between the intensity potential Vdata and the base potential Vbase. A variation in potential at the point S is not more rapid than a variation in potential at the point G because the parasitic capacitance (approximately several pF in this embodiment) of the organic EL element 1 is larger than a capacitance (approximately 100 fF in this embodiment) of the storage capacitor 3. Further, the potential at the point G is written by the saturation operation of the pixel switch 4. In contrast to this, even when the potential at the point S is written by the non-saturation operation of the driver TFT 2, the variation in potential at the point S becomes slower. Therefore, at a timing Td when the variation in potential at the point S is small, the voltage of the pixel switch scanning line GL(n) is set to a high level, the supply of the scanning signal is stopped, and the pixel switch 4 of the target pixel circuit is turned off. Then, a potential difference of "(threshold voltage Vth of driver TFT 2)+(difference between intensity potential Vdata and base potential Vbase)× k-times" is held between the point G and the point S which are both the ends of the storage capacitor 3. This is because, when the pixel switch 4 is turned off, the point G becomes a high impedance, and hence a further potential difference is not provided between the point G and the point S which are both the ends of the storage capacitor 3. Note that "k-times" indicates a variable which is varied by the difference between the intensity potential Vdata and the base potential Vbase.

According to the operation described above, the potential difference between the point G and the point S which are both the ends of the storage capacitor 3 is "(threshold voltage Vth of driver TFT 2)+(difference between intensity potential Vdata and base potential Vbase)×k-times". The potential difference is held in the storage capacitor 3. The potential difference between both the ends of the storage capacitor 3 is a gate-source voltage of the driver TFT 2, and hence the organic EL element 1 is driven by the driver TFT 2 with a signal current corresponding to the voltage described above to emit light with a corresponding intensity.

Therefore, according to the organic EL display including a plurality of pixels in this embodiment, the single pixel switch scanning line GL is used, and hence a desired image may be displayed. Further, the variation in threshold voltage Vth may be cancelled by the control described above to significantly suppress a variation in the amount of current of the light emitting element due to the variation in threshold voltage. Thus, an image quality problem such as a variation in intensity of the light emitting element or intensity burning caused by the shift of the threshold voltage Vth in some cases may be avoided.

According to the pixel circuit PX in the third embodiment described above, as in the first embodiment, each of the pixels in the display region is provided on the single glass substrate and includes the polycrystalline Si-TFT elements. Each of the signal input circuit XDV and the pixel switch control circuit YDV includes the plurality of single-crystalline Si driver IC chips and is provided on the glass substrate. However, each of the signal input circuit XDV and the pixel switch control circuit YDV may include the polycrystalline Si-TFT elements as in the case of each of the pixels. Alternatively, each of the signal input circuit XDV and the pixel switch control circuit YDV may be realized by a combination of using the polycrystalline Si-TFT element in a part of the pixel switch control circuit YDV and the signal input circuit XDV and using the single-crystalline Si driver IC chip in the remaining part thereof.

It is apparent that, in this embodiment, an amorphous Si thin film or another organic/inorganic semiconductor thin film instead of the polycrystalline Si thin film may be used for the transistors, another substrate having an insulating surface may be used instead of the glass substrate, a bottom gate type instead of the top gate type as described above may be used for the transistors, and a bottom emission type instead of the top emission type as described above may be used for the organic EL element 1.

In this embodiment, only the pMOS transistors are particularly used as the TFTs, and hence an organic/inorganic semiconductor thin film which may be applied to only a pMOS transistor may be used for the transistors. In this embodiment, the description is based on the assumption that the ground wiring GD(m) is applied with the ground potential. A voltage is a relative value, and hence the applied potential may be not the ground potential but a reference potential for another signal voltage or power supply voltage.

While there have been described what are at present considered to be certain embodiments of the invention, it will be understood that various modifications may be made thereto, and it is intended that the appended claims cover all such modifications as fall within the true spirit and scope of the invention.

What is claimed is:

1. An image display device, comprising:

a plurality of pixel scanning lines extending in a first direction;

a plurality of signal lines extending in a second direction crossing the first direction; and a plurality of pixel circuits which are provided correspondingly to intersections between the plurality of pixel scanning lines and the plurality of signal lines and driven based on scanning signals supplied to the plurality of pixel scanning lines and image signals supplied to the plurality of signal lines, wherein each of the plurality of pixel circuits includes:

a driver transistor for adjusting an amount of current;

a light emitting element for emitting light based on the current supplied from the driver transistor;

a pixel switch, connected directly to a first one of the pixel scanning lines corresponding to the pixel circuit, for generating a first potential based on one of the scanning signals provided on said first one of the pixel scanning lines coupled to the pixel circuit, and one of the image signals;

a capacitor element having a first end supplied with the first potential from the pixel switch and a second end supplied with a second potential, for controlling the amount of current supplied from the driver transistor based on a potential difference between the first potential and the second potential; and a reset switch, connected to another one of the pixel scanning lines, other than the first one of the pixel scanning lines, said another one of the pixel scanning lines also being connected directly to a pixel switch in another one of the pixel circuits which is adjacent to the pixel circuit in which the reset switch is located, said reset switch being configured for setting a potential at the second end of the capacitor element to a predetermined reference state based on the scanning signal supplied from one of the plurality of pixel scanning lines preceding the scanning signal supplied from another one of the plurality of pixel scanning lines which corresponds to corresponding one of the plurality of pixel circuits, wherein each of the plurality of pixel scanning lines connects directly to the pixel switch included in the corresponding one of the plurality of pixel circuits, and wherein each of the image signals comprises: a base potential which is predetermined and supplied for a first period of time longer than a time constant of the light emitting element; and an intensity potential which corresponds to an intensity of the light emitting element and is supplied for a second period of time shorter than the first period of time immediately after the base potential is supplied so as to correct an amount of current supplied by the driver transistor to suppress variation in the amount of current supplied by the driver transistor which variation is due to variation in threshold voltage of the driver transistor.

2. An image display device according to claim 1, wherein:

the pixel switch is provided between the first end of the capacitor element and one of the plurality of signal lines;

the reset switch includes a first end connected to the second end of the capacitor element and a second end supplied with a reference potential;

the driver transistor includes a source electrode, a gate electrode, and a drain electrode;

the light emitting element includes a first end connected to the source electrode of the driver transistor and a second end supplied with the reference potential;

the first end of the capacitor element is connected to the gate electrode of the driver transistor;

the second end of the capacitor element is connected to the source electrode of the driver transistor; and the drain electrode of the driver transistor is supplied with a power supply potential.

3. An image display device according to claim 2, wherein:

the light emitting element comprises an organic electroluminescence element;

the driver transistor comprises an n-channel transistor;

the first end of the light emitting element is an anode connected to the source electrode of the driver transistor;

the second end of the light emitting element is a cathode supplied with the reference potential; and the power supply potential is higher than the reference potential.

4. An image display device according to claim 2, wherein:

the light emitting element comprises an organic electroluminescence element;

the driver transistor comprises a p-channel transistor;

the first end of the light emitting element is a cathode connected to the source electrode of the driver transistor;

the second end of the light emitting element is an anode supplied with the reference potential; and the power supply potential is lower than the reference potential.

5. An image display device according to claim 1, wherein:

the pixel switch comprises a thin film transistor including a gate electrode connected to the one of the plurality of pixel scanning lines which corresponds to the corresponding one of the plurality of pixel circuits; and the reset switch comprises a thin film transistor including a gate electrode connected to the pixel scanning line which supplies the scanning signal precedingly to the one of the plurality of pixel scanning lines which corresponds to the corresponding one of the plurality of pixel circuits.

6. An image display device according to claim 1, wherein the light emitting element comprises an organic electroluminescence element.

7. An image display device according to claim 1, further comprising a scanning circuit for generating the scanning signals.

8. An image display device according to claim 1, wherein the plurality of pixel circuits are formed on an insulating substrate.

9. The image display device according to claim 1, wherein the base potential and the intensity potential of the image signals have no relationship to a value of a threshold voltage of the driver transistor.

10. An image display device, comprising:

a plurality of pixel scanning lines extending in a first direction;

a plurality of signal lines extending in a second direction crossing the first direction; and a plurality of pixel circuits which are provided correspondingly to intersections between the plurality of pixel scanning lines and the plurality of signal lines and driven based on scanning signals supplied to the plurality of pixel scanning lines and image signals supplied to the plurality of signal lines, wherein each of the plurality of pixel circuits includes:

a driver transistor for adjusting an amount of current;

a light emitting element for emitting light based on the current supplied from the driver transistor;

a pixel switch, connected directly to a first one of the pixel scanning lines corresponding to the pixel circuit, for generating a first potential based on one of the scanning signals provided on said first one of the pixel scanning lines coupled to the pixel circuit, and one of the image signals;

a capacitor element having a first end supplied with the first potential from the pixel switch and a second end supplied with a second potential, for controlling the amount of current supplied from the driver transistor based on a potential difference between the first potential and the second potential; and a reset switch, connected to another one of the pixel scanning lines, other than the first one of the pixel scanning lines, said another one of the pixel scanning lines also being connected directly to a pixel switch in another one of the pixel circuits which is adjacent to the pixel circuit in which the reset switch is located, said reset switch being configured for setting a potential at the second end of the capacitor element to a predetermined reference state based on the scanning signal supplied from one of the plurality of pixel scanning lines preceding the scanning signal supplied from another one of the plurality of pixel scanning lines which corresponds to corresponding one of the plurality of pixel circuits, and means for cancelling variations in a threshold voltage of the driver transistor by configuring each of the image signals to include a base potential, which is predetermined and supplied for a first period of time longer than a time constant of the light emitting element, and an intensity potential which corresponds to an intensity of the light emitting element and is supplied for a second period of time shorter than the first period of time immediately after the base potential is supplied so as to correct an amount of current supplied by the driver transistor to suppress variation in the amount of current supplied by the driver transistor which variation is due to variation in threshold voltage of the driver transistor, wherein each of the plurality of pixel scanning lines connects directly to the pixel switch included in the corresponding one of the plurality of pixel circuits, and wherein the base potential and the intensity potential of the image signals have no relationship to a value of a threshold voltage of the driver transistor.

* * * * *